United States Patent [19]

Miller

[11] Patent Number: 4,520,727

[45] Date of Patent: Jun. 4, 1985

[54] METHOD AND APPARATUS FOR SILK-SCREEN PRINTING

[75] Inventor: Henry L. Miller, Mars, Pa.

[73] Assignee: Miller Screen & Design, Inc., Mars, Pa.

[21] Appl. No.: 588,501

[22] Filed: Mar. 12, 1984

[51] Int. Cl.[3] ..... B05C 17/06; B07B 1/48

[52] U.S. Cl. ..... 101/127; 209/403; 209/405

[58] Field of Search ..... 101/114, 125, 126, 127, 101/128.21, 128.1; 209/403, 405

[56] References Cited

U.S. PATENT DOCUMENTS

| | | | |
|---|---|---|---|
| 3,416,445 | 12/1968 | Krueger | 101/128.1 |
| 3,463,315 | 8/1969 | Riesbeck | 101/127.1 |
| 3,894,487 | 12/1973 | Miller | 101/127 |
| 4,137,842 | 2/1979 | Miller | 101/128.21 |

*Primary Examiner*—Clyde I. Coughenour
*Assistant Examiner*—William L. Klima
*Attorney, Agent, or Firm*—Thomas H. Murray; Clifford A. Poff

[57] ABSTRACT

Method and apparatus for printing a design with a stencil screen including a resilient membrane formed by reversely-bent portions in the screen between a desired pattern defined by a paint-pervious opening in the screen and edge portions of the screen. The reversely-bent portions of the screen are filled with an elastomeric material and extend beyond the bent portions of the screen. A coating of an elastomeric material may be applied to the outside areas of the reversely-bent portions of the screen and adhered to the elastomeric material in the pocket of the screen by permeating the screen openings.

8 Claims, 4 Drawing Figures

METHOD AND APPARATUS FOR SILK-SCREEN PRINTING

BACKGROUND OF THE INVENTION

The present invention relates to a method and apparatus for applying decorative imprints to articles, particularly printing a design with a silk screen having a resilient membrane connected between the screen and a silkscreen support frame.

As is well known in the art, a squeegee is passed across the surface of a stencil screen to force a printing medium through the screen for imprinting a desired design defined by pervious openings in the screen. The printing medium for the imprint may be solvent-based paint or thermally-responsive paint. When thermally-responsive paint is used, it is heated prior to being poured onto the stencil screen where it is forced through an opening in a paint-impervious screen by the squeegee. For successful operation of this process, it is necessary to pass an electric current through the metallic mesh forming the screen so as to heat the same and prevent premature hardening of the thermally-responsive paint.

In my U.S. Pat. No. 4,137,842, there is disclosed a silk-screen printing method and apparatus in which the surface of a silk screen which is brought into contact with the workpiece is coated with a silicone-release agent. A solvent is passed through openings in the wire mesh to remove the coating material from the paint-pervious openings in the screen. The silicone-release agent prevents sticking of the heated screen when brought into contact with the surface of a polyethylene workpiece.

A silk screen is typically comprised of wire mesh stretched between edges of a frame so that end portions of the wire mesh can be wrapped to extend along the sides of the frame and secured thereto. The screen is usually stretched with sufficient tension to eliminate wrinkles and prevent distortions of the desired pattern which is located in a central area of the screen surrounded by the sides of the frame. Sometimes the frame is moved along a path of travel relative to a stationary squeegee to force ink through the paint-pervious openings in the screen; however other drives for the printing process provide that the squeegee moves along a path of travel relative to the screen. In either printing process, the screen is stretched by the squeegee to a small extent each time the printing medium is forced through the paint-pervious openings by the squeegee. After a period of use, the metal or other material used to form the screen fatigues and a tear occurs in the screen. The screen must, therefore, be replaced and usually the entire screen assembly is replaced on the printing machine. The fatigue life of the screen material can be enhanced by attaching a gasket to the lower edge surface of the frame to avoid stretching of the screen across a sharp edge of the frame. However, fatiguing of the screen material still occurs because the screen must be pressed into contact with the workpiece by movement of the squeegee along the screen. The screen is normally positioned a short distance from the surface of the workpiece so that an airgap exists between the screen and the workpiece. The squeegee is moved to displace the screen by the distance of the airgap into contact with the workpiece.

SUMMARY OF THE INVENTION

It is an object of the present invention to provide a resilient membrane in an edge portion of a silk screen between paint-pervious portions defining a desired pattern in the screen and edge portions of the screen which are attached to a frame for support thereby so that the resilient membrane can withstand repeated flexing movement of the middle portion of the screen toward and away from the workpiece as a printing medium is forced through the desired pattern in the screen.

Thus, in accordance with the present invention the foregoing problem of fatiguing of the screen material is eliminated by providing a resilient membrane in the screen between the screen portion which is attached to a silk-screen frame and a middle portion of the screen which undergoes flexing movement toward and away from the workpiece. The resilient membrane is adhered to the screen and preferably, reversely-bent screen portions are established to form a peripheral pocket about the paint-pervious openings in the screen. The edge portions of the screen at the pocket are joined together by the resilient membrane which is preferably comprised of an elastomer such as a mass of cured silicone. It is also preferable to extend the mass of curable silicone outwardly from the reversely-bent portions of the screen forming the pocket. A layer of a curable elastomer may be applied to the outside surface of the screen forming the pocket. The arrangement is such that the elastomer joining the screen portions together in the pocket stretches with long continued longevity as the screen is displaced toward and away from a workpiece during each printing operation.

These features and advantages of the present invention as well as others will be more fully apparent when the following description is read in light of the accompanying drawings, in which.

Figure 1:
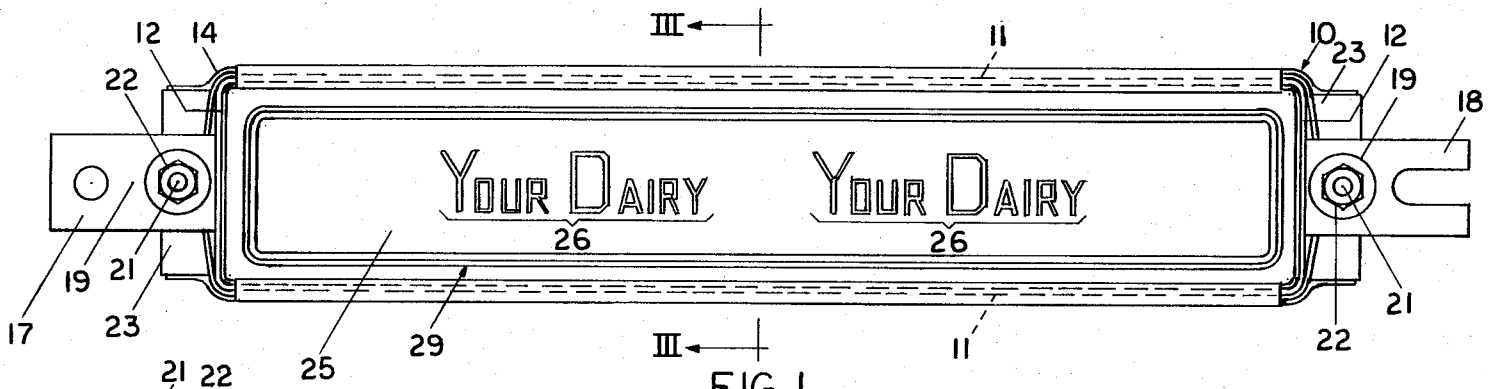
FIG. 1 is a plan view of a stencil screen assembly embodying the features of the present invention.
Figure 2:
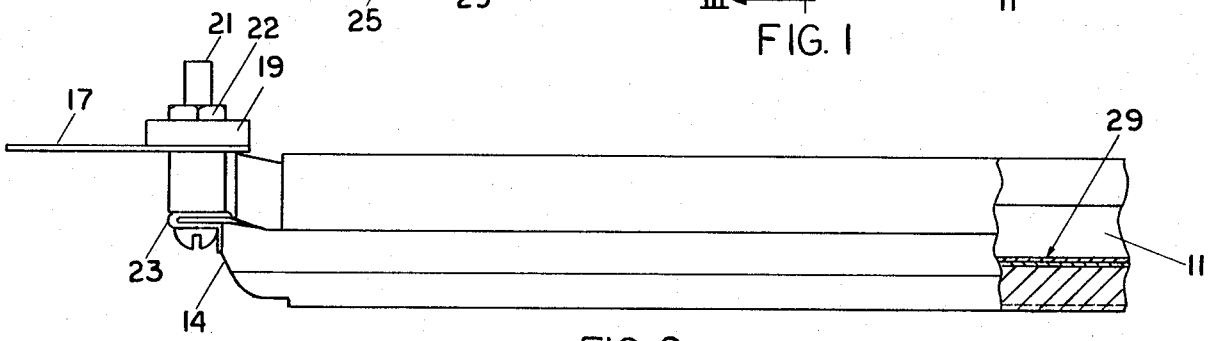
FIG. 2 is an enlarged partial side view of the stencil screen shown in FIG. 1.
Figure 3:
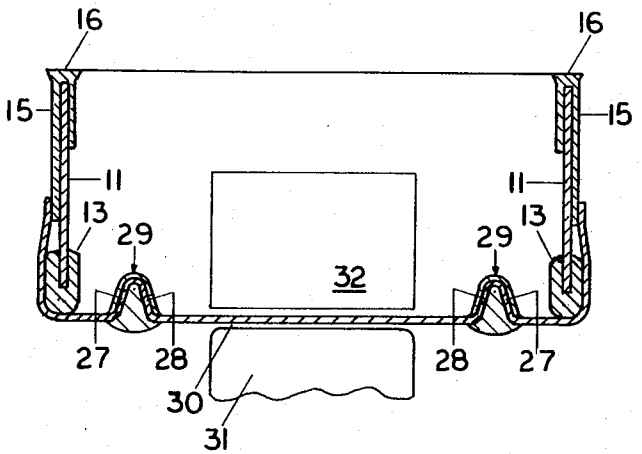
FIG. 3 is a sectional view taken along line III—III of FIG. 1.

In FIGS. 1-3, there is illustrated a stencil screen assembly that includes a rectangularly-shaped metal frame 10 having opposed side walls 11 and opposed end walls 12. A molded rubber gasket 13 forms a continuous member along the bottom edge of walls 11 and 12 for supporting a stencil screen 14. The screen 14 is stretched between the opposed walls of the frame under sufficient tension to avoid the development of undesirable ripples in the screen which would be detrimental to the imprinting process. The longitudinal sides of the screen are attached to an extended leg 15 of a U-shaped clamp 16 which is designed to fit tightly upon the upper edge of the side wall 11. Brackets 17 and 18 extend from end walls 12. These brackets each having an opening with a rubber grommet 19 supported therein. Each grommet receives a screw 21 having a nut 22 threaded on its upper end to hold clamps 23 at each side of the frame to the brackets 17 and 18 while electrically isolated therefrom. The clamps 23 are used as a transition member for clamping the ends of the screen so that it can be, in turn, held under sufficient tension to the frame by screws 21 and nut 22.

The screen is processed in a manner, per se, well known in the art for defining a desired design of an image to be printed. This is accomplished by impregnating the screen with an emulsion or other non-porous substance to leave a residual film 25 within the screen and, to a limited extent, on opposite sides of the screen. The film will be removed from areas to form an ink-pervious opening for the passage of ink onto the surface of a workpiece. For purposes of illustration only, the words "YOUR DAIRY" form ink-pervious openings 26 in the screen.

According to the present invention, surrounding the area of the screen containing openings 26 is a resilient membrane layer 29. The membrane is situated between the area of the screen having the openings 26 and the gasket 13 on the side walls of the frame. In the preferred form of the invention as shown in FIG. 3, the resilient membrane is comprised of a mass of cured elastomer such as silicone or EPDM which is introduced before curing in sufficient quantities into an area defined by reversely-bent portions of the screen. These reversely-bent portions are identified in FIG. 3 by reference numerals 27 and 28. It is preferred to form a V-notch in the screen in which the elastomer fills the notch and extends beyond the lateral sides thereof so as to adhere to the surfaces of the screen that are outwardly from the bent portions 27 and 28 of the screen. However, the elastomer must not extend in the paint-pervious openings 26 of the screen which define the desired pattern to be printed. It is preferable to apply the layer 29 of the same elastomeric material to the surface of the screen on the inside of the frame along the reversely-bent portions 27 and 28 of the screen. In this way, the elastomer will impregnate the open spaces in the screen to join with layers of the elastomeric material on opposite sides of the screen. This has been found to give long continued integrity to the elastomeric material and resiliency to the paint-pervious openings of the screen so that the screen can be displaced through an airgap identified in FIG. 3 by the reference numeral 30. The airgap is normally created between the paint-pervious openings in the screen and a workpiece 31. Also in FIG. 3, there is illustrated a squeegee 32 which is used to displace the screen into contact with the workpiece. The screen may be moved with the workpiece while the squeegee remains stationary or the screen may remain stationary and the squeegee and workpiece moved. In either event, the printing medium is forced through the screen from the side thereof where the squeegee is located to the side of the screen where the workpiece is located. When a thermally-responsive printing medium is used, leads extending from a suitable power supply are attached to screws 21 by means of additional nuts which are jammed against nuts 22. Direct resistance heating of the screen is brought about to maintain the thermally-responsive ink, e.g., thermoplastic ink, in a fluid state until it is brought into contact with the workpiece after passing through the paint-pervious openings in the screen.

Figure 4:
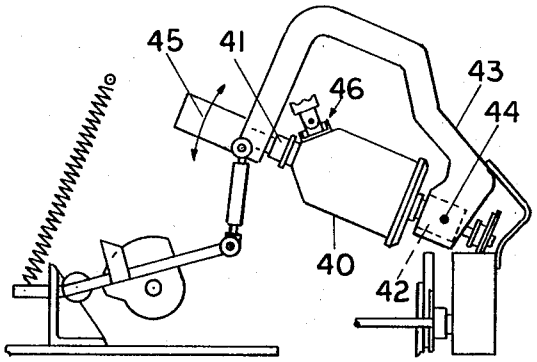
FIG. 4 is a schematic illustration of one manner in which the screen of FIG. 1 can be used to produce decorative imprints on workpieces.

A typical use of the invention is shown in FIG. 4 wherein a plastic workpiece, such as a milk bottle 40 is mounted in a chuck between opposed jaws 41 and 42 carried on a generally C-shaped frame 43. The frame is pivoted as at 44 and can reciprocate in opposite directions indicated by the double-ended arrow 45. Above the milk bottle 40 is a stencil screen and frame assembly such as shown in FIGS. 1–3 and identified by the reference numeral 46. The screen is filled with a printing medium so that when the workpiece is rotated, the stencil screen frame 10 is caused to reciprocate whereby the squeegee 32 will force paint material through the openings in the screen to produce a pattern or design on the workpiece.

It is desirable to apply a layer of silicone-release agent in a manner disclosed in my U.S. Pat. No. 4,137,842 to the surface of the screen which is brought into contact with the workpiece. The release agent is washed from the paint-pervious openings in the screen. In this way, the silicone-release agent which remains on the surface of the screen and may extend across the resilient membrane will prevent sticking of the screen to the workpiece when the screen is heated and thermoplastic paint is used.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a method of applying decorative imprints to the surfaces of workpieces, the steps of:

forming on a stencil screen a paint-impervious layer having a paint-pervious opening therein defining a desired pattern to be imprinted, forming a resilient membrane including establishing a pocket in said stencil screen by reversely-bent portions thereof between said desired pattern and edge portions of said stencil screen.

filling said packet with a curable eastomer, curing said elastomer, securing to a frame the stencil screen by said edge portions, and stretching said resilient membrane while transferring paint through said desired pattern onto the surface of a workpiece.

2. The method according to claim 1 wherein said pocket extends about the outer periphery of said desired pattern.

3. The method according to claim 2 wherein said reversely-bent portions project into a space between side walls forming said frame.

4. A stencil screen assembly including the combination of a stencil screen frame, a stencil screen including screen edge portions supported by said frame, a paint-impervious layer on at least a portion of said screen having a paint-pervious opening situated in the middle portion of said screen between said screen edge portions for defining a desired pattern to be imprinted, and a peripheral pocket defined by reversely-bent screen portions which are joined together by a resilient membrane adhering said screen middle portion to said screen edge portions for flexing movement of said middle portion toward and away from a workpiece as a printing medium is forced through the desired pattern.

5. The stencil screen according to claim 4 wherein said resilient membrane comprises a mass of silicone.

6. The stencil screen according to claim 4 further including means coupled to said screen on opposite sides of said frame for electrically heating the middle portion of said screen.

7. The stencil screen according to claim 4 wherein said membrane comprises an elastomer adhered to said screen.

8. The stencil screen assembly according to claim 4 wherein said membrane is adhered to opposite sides of said screen at said reversely-bent screen portions.

* * * * *